US006056179A

United States Patent [19]

Muzquiz

[11] Patent Number: 6,056,179

[45] **Date of Patent: *May 2, 2000**

[54] SINGLE BAG DISPENSER ROLLHOLDER

[76] Inventor: Federico de Hoyos Muzquiz, Avenida Acapulco No. 221, Colonia La Fe, San Nicolás de Los Garza, Nuevo Leon, C.P. 66477, Mexico

[ * ] Notice: Under 35 U.S.C. 154(b), the term of this patent shall be extended for 427 days.

[21] Appl. No.: 08/502,977

[22] Filed: Jul. 17, 1995

[30] Foreign Application Priority Data

Nov. 11, 1994 [MX] Mexico ..... 948795

[51] Int. Cl.[7] ..... B26F 3/06

[52] U.S. Cl. ..... 225/106; 225/47; 225/48; 225/93

[58] Field of Search ..... 225/39, 106, 46, 225/47, 48, 49, 93; 83/13

[56] References Cited

U.S. PATENT DOCUMENTS

| | | | |
|---|---|---|---|
| Re. 25,876 | 10/1965 | Buttery et al. | 225/48 |
| 2,382,659 | 8/1945 | Olson | 225/47 |
| 2,507,403 | 5/1950 | Gluck | 225/48 |
| 3,319,854 | 5/1967 | Palmer | 225/47 |
| 4,738,385 | 4/1988 | Bell | 225/106 |
| 5,024,349 | 6/1991 | Haenni et al. | 225/106 |
| 5,097,998 | 3/1992 | Shimasaki | 225/106 |
| 5,118,022 | 6/1992 | Farahnik | 225/106 |
| 5,207,368 | 5/1993 | Wilfong, Jr. et al. | 225/106 |

FOREIGN PATENT DOCUMENTS

| | | | |
|---|---|---|---|
| 427365 | 5/1991 | European Pat. Off. | 83/13 |

*Primary Examiner*—Rinaldi I. Rada
*Assistant Examiner*—Charles Goodman
*Attorney, Agent, or Firm*—John R Casperson

[57] ABSTRACT

A rollholder for a roll of polyethylene bags is formed from a hollow polygonal box having rectangular sides with a shaft in the middle upon which the roll of bags is placed. One of the sides of the box has a toothed slot from which the bags are dispensed one at a time.

6 Claims, 3 Drawing Sheets

FIG. 1
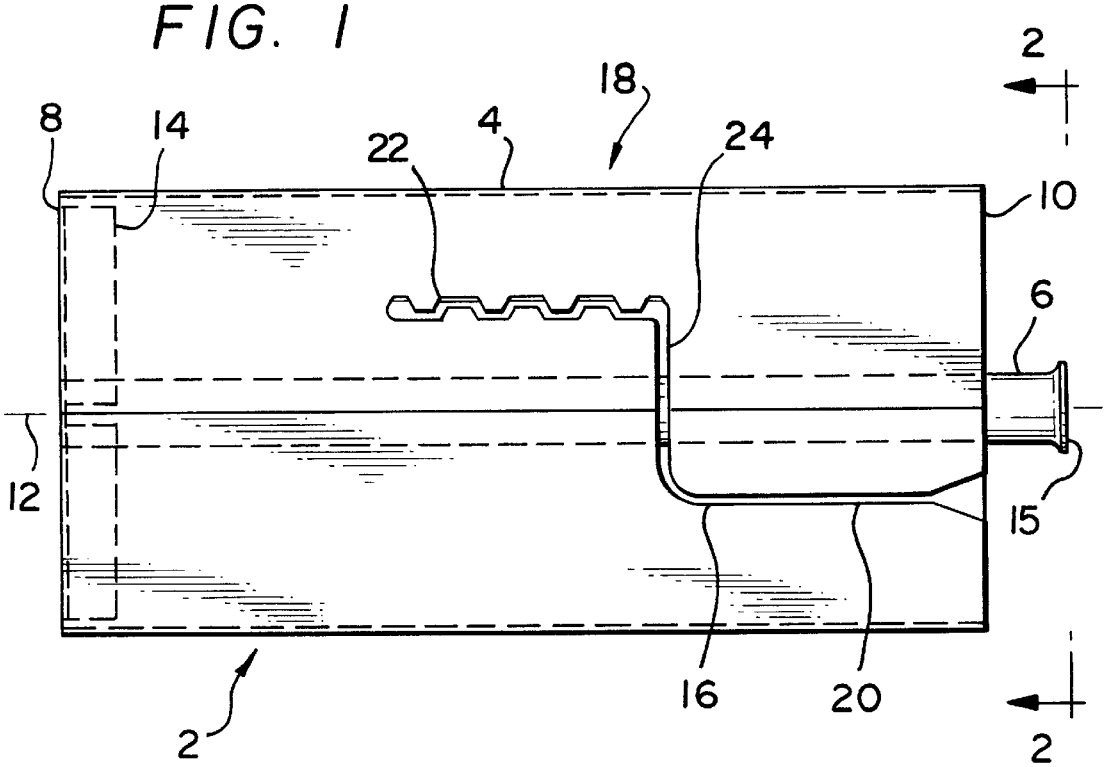
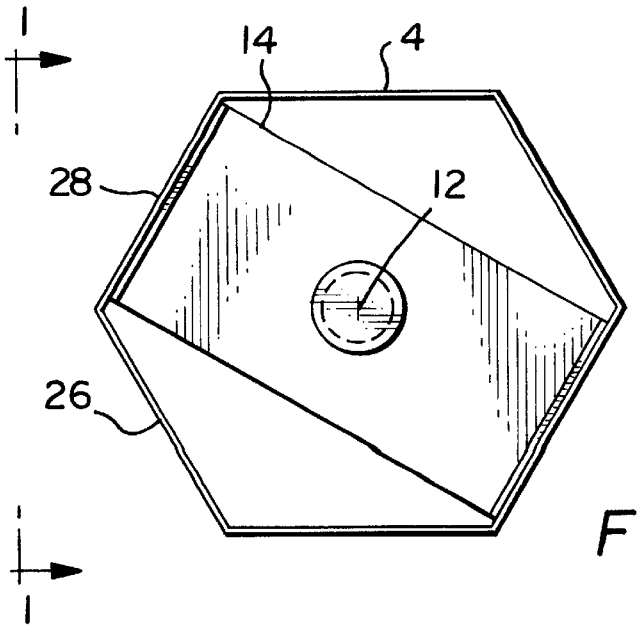
FIG. 2

SINGLE BAG DISPENSER ROLLHOLDER

BACKGROUND OF THE INVENTION

The invention herewith refers to dispensers, that is, a container provided with a device to supply an article or product and more particularly it refers to a dispenser of polyethylene bags, "one at a time", which by its features it allows to take one bag in an easier and faster way, compared to other known dispensers.

There are known dispensers of bags or paper towels, consisting of a container with an interior shaft where a roll of bags or towels is placed; when a person needs one of these articles, he has to use both hands to pull straight such article and then separate the bag or towel from the rest of the roll. On these dispensers, there is no control over the quantity supplied , because bags or towels can be taken as needed and not separated until desired, which has an impact on costs and expenses.

OBJECTS OF THE INVENTION

The object of the invention is, to provide an innovative dispenser where the features provided allow for the control of the consumption of the bags in the roll as needed, because they precisely separate one at a time while it facilitates the use of the same.

SUMMARY OF THE INVENTION

In its preferred presentation, the dispenser consists in a hollow polygon, for example hexagonal, provided with a shaft in the middle to receive the rolls of bags. The rolls are preferably formed individual bags connected end to end at perforation lines with a central slot in the middle part of the perforation line. One of the sides has a smooth slot from which one of the bags is initially pulled and then, on an adjacent side, it has a special design of a wedge exit with teeth which acts as an anchor to grab such bags from the middle, previously separated in the production line.

This way, it is possible to get one bag with only one hand and under control since the bag will be cut or seperated from the roll one at a time.

We will proceed to make a detailed description of the invention, in connection with the attached drawings, given only as an example. The invention can be modified in the shape and sides of the box, in its dimensions, materials and colors. The special design of the box for the entrance and exit of the bag is what makes the invention superior to currently available bag dispensers.

BRIEF DESCRIPTION OF THE DRAWINGS

FIG. 1 is side view of the dispenser made according to the present invention.

FIG. 2 is a and end view of the dispenser of FIG. 1, taken along lines 2—2.

DETAILED DESCRIPTION OF THE PREFERRED EMBODIMENTS

Figure 3:
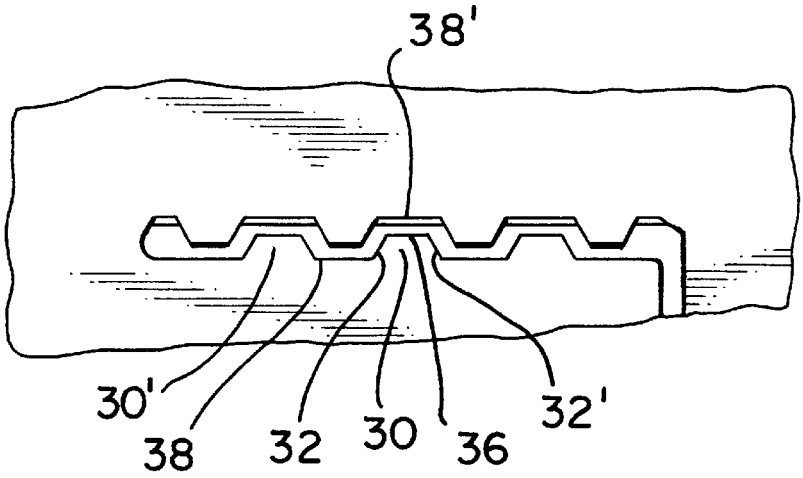
FIG. 3 is an enlarged view of a portion of the dispenser shown in FIG. 1.
Figure 4:
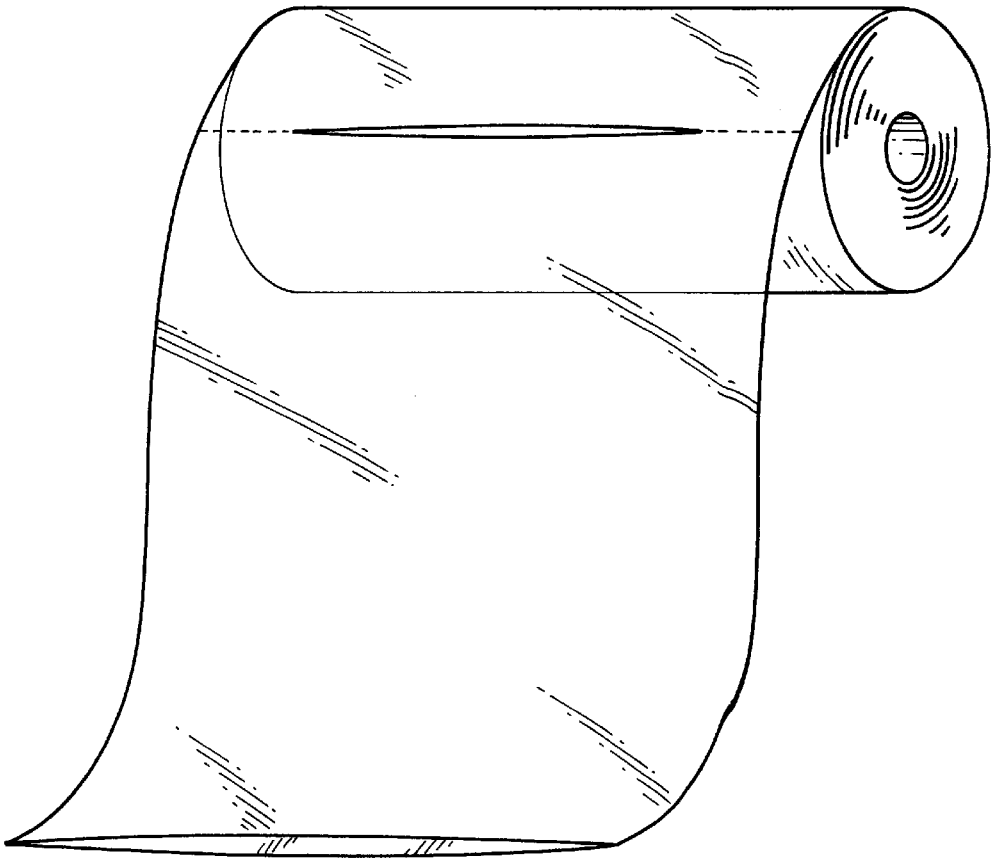
FIG. 4 is a pictorial representation of a roll of bags especially suitable for use in the invention.
Figure 5:
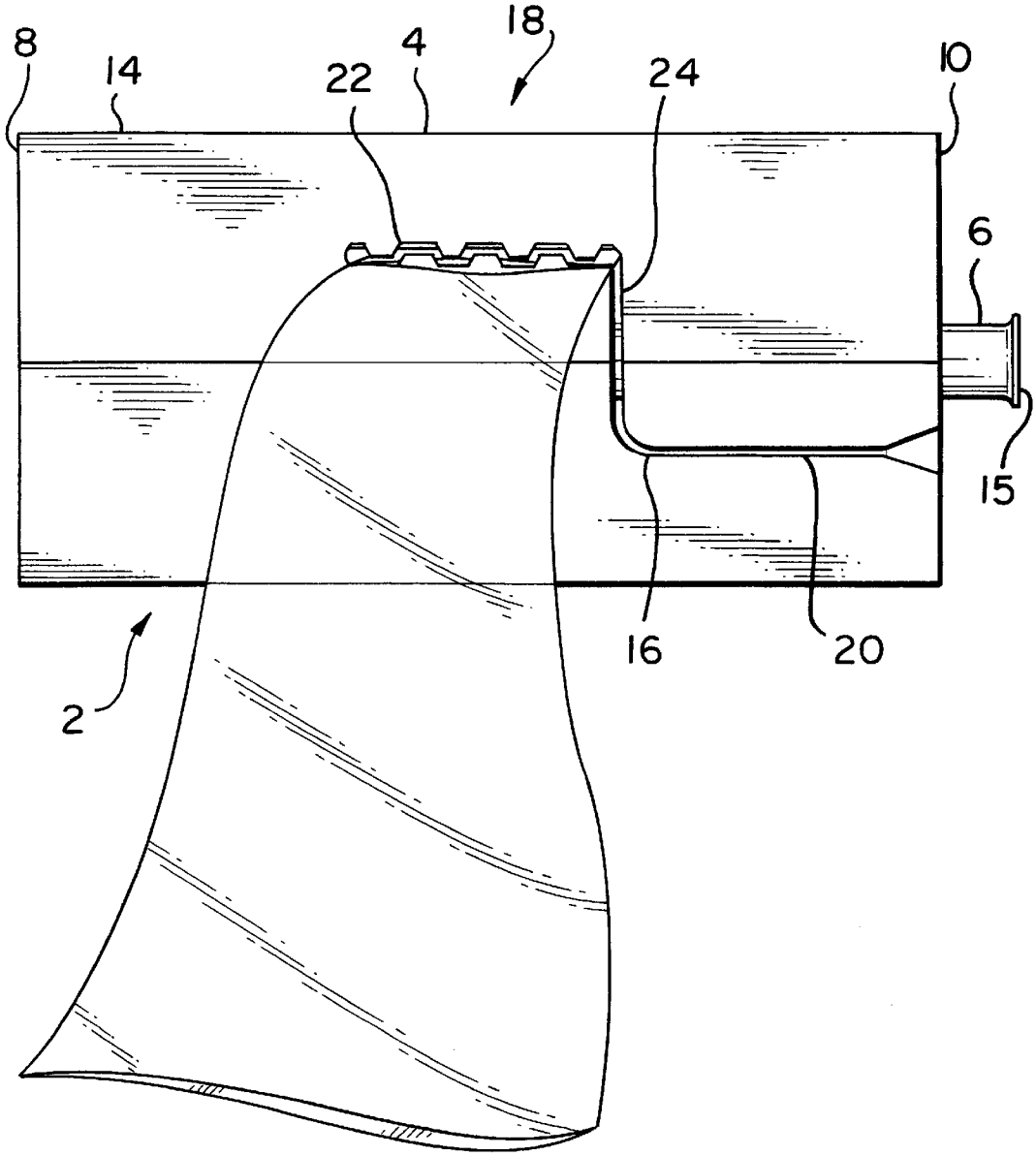
FIG. 5 is a pictorial representation of the invention in use.

In the Figures, a hexagonal box is shown which has a shaft in the middle to receive a roll of polyethylene bags. On one of the sides of the box there is a smooth slot and on the other adjacent side there is a corrugated slot.

With this arrangement, the bags will be separated only one at a time and also the supply of bags will be simplified since this can be done with only one hand and not two like the dispenser of the previous technology.

The polyethylene bags on the rolls are preferably separated by one or more slots several centimeters in length in addition to the usual perforations. Preferably, a single central slot is employed, having a length of about two thirds of the width of the bag. The corrugated teeth of the slot engage the slot in the bag to enable a single bag to be dispensed from the roll.

Although the invention can be used to dispense bags from low density polyethylene, it is preferred that the bags be formed from a blend of high density polyethylene and linear low density polyethylene. Good results can be obtained when the bags are formed from a blend containing more than 50% by weight high density polyethylene. The bags are preferably translucent. Preferably, the bags have a thickness of less than 0.4 mils, even more preferably less than 0.35 mils. For example, bags having a thickness in the range of from about 0.25 to about 0.35 mils are expected to provide good results. It will be appreciated by those skilled in the art that such bags will find use the produce section of grocery stores. Other types of utility bags, such as garbage bags and store and grocery store bags, generally require a greater thickness, and are usually formed from an opaque material.

With reference to the Figures, an apparatus 2 comprises a housing 4 having a central shaft 6. The housing 4 has a first end 8, a second end 10, and a longitudinal axis 12.

A frame member 14 extends across the first end of the housing. The shaft 6 extends from the frame member at least partially through the housing along the longitudinal axis of the housing. Preferably, the shaft 6 protrudes a short distance from the second end of the housing and is provided with a means for retaining a roll of bags on the shaft such as an end disk 15 of larger diameter than the shaft.

The housing 4 defines a slot 16 extending from the second end of the housing to a mid-portion 18 of the housing. The slot has a first generally longitudinally extending portion 20 extending from the second end 10 of the housing and a second generally longitudinally extending portion 22 located at the midportion of the housing. A generally circumferentially extending portion 24 of the slot connects the first generally longitudinally extending portion 20 with the second generally longitudinally extending portion 22.

The first generally longitudinally extending portion 20 of the slot is defined by a pair of smooth opposed edge surfaces of the housing. The second generally longitudinally extending portion 22 of the slot is defined by a pair of opposed interdigitating toothed edge surfaces of the housing.

Preferably, the housing has a polygonal cross section and is formed from a plurality of generally rectangular sides 26 and 28, for example. The second end 10 of the housing is preferably open to form a chamber for receipt of a roll of polyethylene bags on the shaft.

In the illustrated embodiment of the invention, the first generally longitudinally extending portion 20 of the slot is formed in a first of the generally rectangular sides of the housing 26 and the second generally longitudinally portion 22 of the slot is formed in a second of the generally rectangular sides of the housing 28. The first generally rectangular side 26 is adjacent to the second generally rectangular side 28. However, good results can also be obtained by providing the portions 20 and 22 of the slot in the same generally rectangular side. The housing most preferably has a hexagonal cross section and the second generally longitudinally extending portion of the slot follows an undulating path between the teeth. The first generally longitudinally extending portion of the slot preferably widens near the second end of the housing to facilitate feeding a bag into the slot.

The design of the teeth is an important consideration. Preferably, each tooth 30 in a portion of the teeth in the second generally longitudinally extending portion 22 of the slot can be defined by a pair of flanks joined by a crest 36. The flanks of adjacent teeth 30, 30' are joined by a root 38. The crests 36 and roots 38 of the teeth 30 are truncated. The flanks 32, 32' of the teeth taper toward the crest 36. The crests and roots of opposed teeth across the slot portion 22 are preferably separated by a crest clearance (as measured between crest 36 and root 38', for example) of about one eighth inch. Preferably, only a few teeth 30 line the slot. For example, from 3 to 10 teeth on each side, preferably from 3 to 6 teeth, are expected to provide good results. Each tooth preferably has a height in the range of from about 0.2 to about 1.0 cm, preferably in the range of from about 0.3 to about 0.6 cm. The length of the second generally longitudinal portion 22 of the slot (the toothed portion) depends on the width of the bag to be dispensed, but generally will be in the range of from about 25% to about 50% of the width of the bag, or from about 20% to about 40% of the length of the housing.

What is claimed is:

1. A dispenser for dispensing single polyethylene bags from a roll of polyethylene bags, said dispenser comprising a housing having a first end and a second end, said housing having a longitudinal axis, said housing having a length as measured between the first end and the second end, a frame member extending across the first end of the housing, and a shaft extending from the frame member at least partially through the housing along the longitudinal axis of the housing, wherein the housing defines a slot extending from the second end of the housing to a mid-portion of the housing, said slot having a first generally longitudinally extending portion extending from the second end of the housing and a second generally longitudinally extending portion located at the midportion of the housing, and a generally circumferentially extending portion connecting the first generally longitudinally extending portion with the second generally longitudinally extending portion, wherein the first generally longitudinally extending portion of the slot is defined by a pair of smooth opposed edge surfaces of the housing, and wherein the second generally longitudinally extending portion of the slot follows an undulating path defined by a pair of opposed interdigitating toothed edge surfaces of the housing wherein the toothed edge surfaces define a plurality of teeth; and wherein each tooth in a portion of the teeth is defined by a pair of flanks joined by a crest, wherein the flanks of adjacent teeth are joined by a root, wherein the crests and roots of the teeth are truncated, and the crests and roots of opposed teeth across the slot are separated by a crest clearance of about one eighth inch;

said dispenser containing a roll of polyethylene bags separated by a single central slot and perforations and having a wall thickness of less than about 0.4 mils with the pair of opposed interdigitating toothed edge surfaces of the housing engaging a central slot separating two bags to enable a single bag to be dispensed from the roll.

2. A dispenser as in claim 1 wherein the housing has a polygonal cross section and is formed from a plurality of generally rectangular sides and the second end of the housing is open to form a chamber which receives the roll of polyethylene bags on the shaft.

3. A dispenser as in claim 2 wherein the first generally longitudinally extending portion of the slot is formed in a first of said generally rectangular sides of the housing and the second generally longitudinally extending portion of the slot is formed in a second of said generally rectangular sides of the housing, wherein the first generally rectangular side is adjacent to the second generally rectangular side.

4. A dispenser as in claim 2 wherein the housing has a hexagonal cross section and the length of the second generally longitudinal portion of the slot is in the range of from about 20% to about 40% of the length of the housing.

5. A dispenser as in claim 2 wherein the first generally longitudinally extending portion of the slot widens near the second end of the housing and the second generally longitudinally extending portion of the slot has from 3 to 10 teeth on each side.

6. A dispenser as in claim 1 wherein the flanks of each tooth taper toward the crest.

* * * * *